US006753304B1

(12) United States Patent
Barthelemy et al.

(10) Patent No.: US 6,753,304 B1
(45) Date of Patent: Jun. 22, 2004

(54) COMPOSITIONS COMPRISING PERFLUOROBUTYL METHYL ETHER AND USE OF SAID COMPOSITIONS

(75) Inventors: Pierre Barthelemy, Pietrebais (BE); Pierre Dournel, Brussels (BE)

(73) Assignee: Solvay (Societe Anonyme) (BE)

( * ) Notice: Subject to any disclaimer, the term of this patent is extended or adjusted under 35 U.S.C. 154(b) by 163 days.

(21) Appl. No.: 09/581,440

(22) PCT Filed: Dec. 12, 1998

(86) PCT No.: PCT/EP98/08160

§ 371 (c)(1),
(2), (4) Date: Aug. 28, 2000

(87) PCT Pub. No.: WO99/31214

PCT Pub. Date: Jun. 24, 1999

(30) Foreign Application Priority Data

Dec. 15, 1997 (BE) ..... 9701016

(51) Int. Cl.[7] ..... C11D 17/00

(52) U.S. Cl. ..... 510/411; 510/412; 510/286; 510/291; 252/364

(58) Field of Search ..... 510/411, 412, 510/291, 286; 424/9.5, 9.52; 514/228.2; 252/364

(56) References Cited

U.S. PATENT DOCUMENTS

| | | | | |
|---|---|---|---|---|
| 5,674,825 | A | | 10/1997 | Buchwald et al. |
| 5,714,298 | A | | 2/1998 | Barthelemy et al. |
| 5,769,935 | A | | 6/1998 | Swan |
| 5,814,595 | A | * | 9/1998 | Flynn et al. |
| 5,827,812 | A | * | 10/1998 | Flynn et al. |

FOREIGN PATENT DOCUMENTS

| | | |
|---|---|---|
| EP | 0784238 | 7/1997 |
| WO | WO 96/22356 | 7/1996 |
| WO | 96/36688 | 11/1996 |
| WO | 96/36689 | 11/1996 |
| WO | 97/28229 | 8/1997 |

* cited by examiner

*Primary Examiner*—Gregory Webb
(74) *Attorney, Agent, or Firm*—Connolly Bove Lodge & Hutz LLP

(57) ABSTRACT

Perfluorobutyl methyl ether forms azeotropic or pseudoazeotropic compositions with esters. These compositions can be used in particular as solvent for cleaning and defluxing electronic components, for degreasing metals, for removing water adsorbed at the surface of solids and for fixing a toner to a printing substrate.

14 Claims, No Drawings

COMPOSITIONS COMPRISING PERFLUOROBUTYL METHYL ETHER AND USE OF SAID COMPOSITIONS

The invention relates to compositions comprising perfluorobutyl methyl ether ($C_4F_9$—O—$CH_3$) and to the use of these compositions, in particular as agent for cleaning or drying solid surfaces.

Completely halogenated chlorofluorohydrocarbons (CFCs), in particular 1,1,2-trichloro-1,2,2-trifluoro-ethane (CFC-113), are widely used as solvents in industry for degreasing and cleaning various surfaces, particularly for solid components of complicated shape which are difficult to clean. In addition to their application in electronics, in the cleaning of soldering flux, to remove the soldering flux which adheres to printed circuits, they are also conventionally used to degrease metal components or to clean metal components of high quality and of high accuracy. In these various applications, CFC-113 is generally used in combination with other organic solvents, preferably in the form of azeotropic compositions or pseudoazeotropic compositions having substantially the same composition in the vapour phase and in the liquid phase, so that they can be easily employed at reflux.

Compositions based on CFC-113 are also conventionally used as drying agent, in order to remove the water adsorbed at the surface of solid components.

However, CFC-113, as well as other completely halogenated chlorofluoroalkanes, it is today suspected of being involved in the destruction of the stratospheric ozone layer.

Consequently, there is currently an urgent need to find novel compositions which do not have a harmful effect on the ozone layer.

Chlorine-free hydrofluorinated compounds are completely inert with respect to the stratospheric ozone layer and these compounds are found to be increasingly widely used in numerous applications, at the expense of the compounds carrying chlorine atoms.

To this end, Patent Application WO 96/36689 provides azeotropic compositions formed of perfluorobutyl methyl ether with one or more organic solvents chosen from linear or branched and cyclic or acyclic alkanes comprising from 6 to 8 carbon atoms, cyclic or acyclic ethers comprising from 4 to 6 carbon atoms, ketones comprising 3 carbon atoms, chlorinated alkanes comprising 1, 3 or 4 carbon atoms, chlorinated alkenes comprising 2 to 3 carbon atoms, alcohols comprising 1 to 4 carbon atoms, partially fluorinated alcohols comprising 2 to 3 carbon atoms, 1-bromopropane, acetonitrile, HCFC-225ea and HCFC-225cb.

One of the objectives of the present invention is to furnish other compositions which optionally form azeotropes or pseudoazeotropes and which have a particularly good performance when they are used as cleaning agent in solvent cleaning processes. A further object of the invention is such compositions possessing properties particularly suited to the cleaning of printed circuit boards. Another objective of the invention is to furnish such compositions devoid of a destructive effect with regard to the ozone layer.

Another object of the invention is compositions possessing particularly suitable properties as agent for fixing a toner to a recording substrate in a device for printing or reproducing documents.

The present invention consequently relates to compositions comprising a perfluorobutyl methyl ether and a cosolvent. It relates more particularly to the compositions comprising a perfluorobutyl methyl ether of general formula $C_4F_9$—O—$CH_3$, where $C_4F_9$ is a linear or branched perfluorinated chain, and an organic solvent possessing an ester functional group. $CF_3$—$(CF_2)_3$—O—$CH_3$, $(CF_3)_2CF$—$CF_2$—O—$CH_3$ and their mixtures are the preferred perfluorobutyl methyl ethers. In the continuation of the account, the term "perfluorobutyl methyl ether" is used to denote a mixture of these 2 compounds sold by 3M under the name HFE-7100. Mention may be made, as examples of organic compounds comprising an ester functional group, of methyl formate, ethyl formate, propyl formate, methyl acetate, ethyl acetate, propyl acetate, methyl propionate, ethyl propionate or propyl propionate.

Methyl formate, ethyl formate, methyl acetate and ethyl acetate are preferred. Methyl formate, ethyl formate and methyl acetate are particularly preferred.

The thermodynamic state of a fluid is fundamentally defined by four interdependent variables: the pressure (P), the temperature (T), the composition of the liquid phase (X) and the composition of the gas phase (Y). A true azeotrope is a specific system comprising 2 or more components for which, at a given temperature and at a given pressure, the composition of the liquid phase X is exactly the same as the composition of the gas phase Y.

A pseudoazeotrope is a system comprising 2 or more components for which, at a given temperature and at a given pressure, X is substantially the same as Y. In practice, this means that the constituents of such azeotropic and pseudoazeotropic systems cannot be easily separated by distillation and consequently their composition remains substantially constant in solvent cleaning operations and in operations for the recovery of waste solvents by distillation.

For the purposes of the present invention, the term "pseudoazeotropic mixture" is understood to mean a mixture of two constituents with a boiling point (at a given pressure) which differs from the boiling point of the true azeotrope by at most 0.5° C. Mixtures with a boiling point which differs from the boiling point of the true azeotrope by at most 0.2° C. are preferred. Mixtures with a boiling point which differs from the boiling point of the true azeotrope by at most 0.1° C. are particularly preferred.

The contents of perfluorobutyl methyl ether and of ester in the compositions according to the invention can vary within wide limits, depending upon the use envisaged.

The compositions according to the invention generally comprise at least 1% by weight of perfluorobutyl methyl ether. They advantageously comprise at least 5% thereof. In a particularly preferred way, they comprise at least 10% thereof. They can comprise up to 99% thereof. They generally comprise at most 95% thereof.

Compositions according to the invention which are very particularly preferred are those which comprise perfluorobutyl methyl ether and an ester in proportions in which they form a minimum boiling point azeotrope or pseudoazeotrope.

The compositions of the azeotropic mixtures according to the; invention were evaluated on the basis of the results of the experimental measurements presented in the examples hereinbelow.

Perfluorobutyl methyl ether and methyl acetate form a binary azeotrope or pseudoazeotrope when their mixture comprises approximately from 21 to 52% by weight of methyl acetate. The binary compositions comprising approximately from 28 to 48% by weight of methyl acetate are preferred. Under a pressure of 102.3 kPa, the binary composition composed essentially of approximately 61% by weight of perfluorobutyl methyl ether and of approximately 39% by weight of methyl acetate constitutes a true azeotrope, the boiling point of which is approximately 52.6° C. This composition is very particularly preferred.

Perfluorobutyl methyl ether and ethyl formate form a binary azeotrope or pseudoazeotrope when their mixture comprises approximately from 22 to 53% by weight of ethyl formate. The binary compositions comprising approximately from 26 to 46% by weight of ethyl formate are preferred. Under a pressure of 102.6 kPa, the binary composition composed essentially of approximately 68% by weight of perfluorobutyl methyl ether and of approximately 32% by weight of ethyl formate constitutes a true azeotrope, the boiling point of which is approximately 50.2° C. This composition is very particularly preferred.

Perfluorobutyl methyl ether and methyl formate form a binary azeotrope or pseudoazeotrope when their mixture comprises approximately from 40 to 92% by weight of methyl formate. The binary compositions comprising approximately from 59 to 80% by weight of methyl formate are preferred. Under a pressure of 102.2 kPa, the binary composition composed essentially of approximately 36% by weight of perfluorobutyl methyl ether and of approximately 64% by weight of methyl formate constitutes a true azeotrope, the boiling point of which is approximately 31.2° C. This composition is very particularly preferred.

Various additives can optionally be present in the compositions according to the invention. The composition according to the invention can thus comprise stabilizing agents, surface-active agents or any other additive which makes it possible to improve the performances of the compositions according to the invention when they are used. The nature and the amount of these additives depend upon the use envisaged and are easily defined by a person skilled in the art. As a general rule, the amount of additives present in the compositions according to the invention does not exceed approximately 20% of the weight of the composition and generally is not more than 10%.

The compositions according to the invention exhibit an appropriate boiling point for replacing compositions based on CFC-113 in existing cleaning devices. As regards its impact on the environment, perfluorobutyl methyl ether appears to be particularly advantageous since it exhibits a zero destructive potential with regard to ozone. The compositions according to the invention are, in addition, inert with regard to the various types of surfaces to be treated, whether the latter are made of metal, of plastic or of glass.

The compositions according to the invention can consequently be used in the same applications and according to the same techniques as prior compositions based on CFC-113. In particular, the compositions according to the invention can be used as cleaning, solvent, degreasing, defluxing or drying agent.

The invention consequently also relates to the use of the compositions according to the invention as cleaning agent, as agent for degreasing solid surfaces, as agent for cleaning printed circuit boards contaminated by a soldering flux and residues from this flux, or as drying agent for removing the water adsorbed at the surface of solid objects.

Perfluorobutyl methyl ether, the compositions comprising it and, in particular the compositions according to the invention can also be used as agent for fixing a toner to a recording substrate in a device for printing or reproducing documents.

Compositions based on perfluorobutyl methyl ether which can be used as agent for fixing a toner are compositions comprising a $C_3$–$C_6$ hydrofluorocarbon. The term "$C_3$–$C_6$ hydrofluorocarbon" is understood to denote saturated aliphatic or alicyclic hydrocarbons composed solely of carbon, of fluorine and of hydrogen comprising from 3 to 6 carbon atoms, at least one fluorine atom and at least one hydrogen atom. Typical examples of $C_3$–$C_6$ hydrofluorocarbons are hydrofluoroalkanes, such as 1,1,1,3,3-pentafluoropropane (HFC-245fa), 1,1,1,3,3-pentafluorobutane (HFC-365mfc) and 1,1,1,2,2,3,4,6,6,6-decafluoropentane (HFC-43-10mee). 1,1,1,3,3-Pentafluorobutane is particularly well suited. Use is preferably made of ternary perfluorobutyl methyl ether/ester/$C_3$–$C_6$ hydrofluorocarbon compositions.

The invention consequently also relates to the use of perfluorobutyl methyl ether, of the compositions comprising it and, in particular, of the compositions according to the invention as agent for fixing a toner to a recording substrate in a device for printing or reproducing documents.

The non-limiting examples hereinbelow illustrate the invention in a more detailed way.

EXAMPLES 1–3

To demonstrate the existence of azeotropic or pseudoazeotropic compositions according to the invention between perfluorobutyl methyl ether and an ester, use was made of glass equipment composed of a 50 ml distillation flask surmounted by a reflux condenser. The temperature of the liquid was measured by means of a thermometer immersed in the flask.

An amount of pure perfluorobutyl methyl ether determined with accuracy was heated under a known pressure until boiling and then small amounts, weighed with accuracy, of ester were gradually introduced into the flask by means of a syringe via a sidearm.

The azeotropic composition was determined by plotting the change in the boiling temperature of the mixture as a function of its composition.

These measurements were made for mixtures comprising perfluorobutyl methyl ether and increasing amounts of methyl acetate (Example 1), of ethyl formate (Example 2) and of methyl formate (Example 3).

The pressure at which the measurements were taken is mentioned. The results obtained are presented in Table I.

TABLE I

| Example 1 Perfluorobutyl methyl ether/methyl acetate composition (Pressure: 102.3 kPA) | | Example 2 Perfluorobutyl methyl ether/ethyl formate composition (Pressure: 102.6 kPA) | | Example 3 Perfluorobutyl methyl ether/methyl formate composition (Pressure: 102.2 kPA) | |
|---|---|---|---|---|---|
| % by weight of methyl acetate | B.t. (° C.) | % by weight of ethyl formate | B.t. (° C.) | % by weight of methyl formate | B.t. (° C.) |
| 0 | 60.2 | 0 | 60.2 | 0 | 60.2 |
| 1.86 | 58.8 | 1.98 | 58.2 | 0.92 | 57.2 |
| 2.78 | 58 | 3.40 | 56.8 | 4.49 | 49 |
| 3.76 | 57.6 | 4.96 | 55.6 | 7.08 | 44.4 |
| 4.88 | 56.8 | 6.83 | 54.6 | 8.95 | 42 |
| 7.29 | 55.6 | 9.26 | 53.4 | 18.55 | 35 |
| 9.69 | 54.8 | 12.16 | 52.4 | 22.91 | 33.8 |
| 13.72 | 53.8 | 13.95 | 52 | 34.50 | 32.4 |
| 16.74 | 53.4 | 16.07 | 51.6 | 39.66 | 31.8 |
| 19.03 | 53.3 | 18.74 | 51.2 | 45.22 | 31.6 |
| 21.44 | 53.1 | 22.24 | 50.8 | 51.69 | 31.4 |
| 24.26 | 53 | 26.47 | 50.4 | 63.96 | 31.2 |
| 33.96 | 52.8 | 31.44 | 50.2 | 79.91 | 31.3 |
| 39.11 | 52.6 | 40.10 | 50.4 | 87.66 | 31.4 |
| 44.32 | 52.7 | 49.47 | 50.6 | 90.82 | 31.6 |
| 48.58 | 52.8 | 54.13 | 50.8 | 93.31 | 31.8 |

TABLE I-continued

| Example 1 Perfluorobutyl methyl ether/methyl acetate composition (Pressure: 102.3 kPA) | | Example 2 Perfluorobutyl methyl ether/ethyl formate composition (Pressure: 102.6 kPA) | | Example 3 Perfluorobutyl methyl ether/methyl formate composition (Pressure: 102.2 kPA) | |
|---|---|---|---|---|---|
| % by weight of methyl acetate | B.t. (° C.) | % by weight of ethyl formate | B.t. (° C.) | % by weight of methyl formate | B.t. (° C.) |
| 52.68 | 53.2 | 67.56 | 51.2 | 95.47 | 32 |
| | | 79.09 | 52.2 | | |

What is claimed is:

1. Composition comprising at least one perfluorobutyl methyl ether of formula $C_4F_9$—O—$CH_3$, in which $C_4F_9$ represents a linear or branched perfluorinated chain, and at least one ester, wherein the ester is ethyl acetate, methyl acetate, ethyl formate or methyl formate.

2. Composition according to claim 1, in which the perfluorobutyl methyl ether is chosen from $CF_3$—$(CF_2)_3$—O—$CH_3$, $(CF_3)_2CF$—$CF_2$—O—$CH_3$ and their mixtures.

3. Azeotropic or pseudoazeotropic composition according to claim 1, characterized in that the ester is chosen from methyl acetate, ethyl formate and methyl formate.

4. Composition according to claim 3, comprising approximately 21 to 52% by weight of methyl acetate or approximately 22 to 53% by weight of ethyl formate or approximately 40 to 92% by weight of methyl formate.

5. Composition according to claim 3, comprising approximately 28 to 48% by weight of methyl acetate or approximately 26 to 46% by weight of ethyl formate or approximately 59 to 80% by weight of methyl formate.

6. Minimum boiling point azeotropic composition according to claim 3, composed of approximately 61% by weight of perfluorobutyl methyl ether and of approximately 39% by weight of methyl acetate, the boiling point of which is approximately 52.6° C. under a pressure of 102.3 kPa.

7. Minimum boiling point azeotropic composition according to claim 3, composed of approximately 68% by weight of perfluorobutyl methyl ether and of approximately 32% by weight of ethyl formate, the boiling point of which is approximately 50.2° C. under a pressure of 102.6 kPa.

8. Minimum boiling point azeotropic composition according to claim 3, composed of approximately 36% by weight of perfluorobutyl methyl ether and of approximately 64% by weight of methyl formate, the boiling point of which is approximately 31.2° C. under a pressure of 102.2 kPa.

9. Composition according to claim 1, further comprising a $C_3$–$C_6$ hydrofluorocarbon.

10. A cleaning agent which comprises the composition as claimed in claim 1.

11. The cleaning agent as claimed in claim 10, wherein the cleaning agent is capable of degreasing solid surfaces or cleaning printed circuit boards contaminated by a soldering flux or residues from said flux.

12. A drying agent comprising the composition as claimed in claim 1, wherein said drying agent is useful for removing water adsorbed at the surface of a solid object.

13. An agent for fixing a toner to a recording substrate in a device for printing or reproducing documents which comprises a perfluorobutyl methyl ether.

14. A composition comprising at least one perfluorobutyl methyl ether of formula $C_4F_9$—O—$CH_3$, in which $C_4F_9$ represents a linear or branched perfluorinated chain, an ester and a $C_3$–$C_6$ hydrofluorocarbon.

* * * * *

UNITED STATES PATENT AND TRADEMARK OFFICE

CERTIFICATE OF CORRECTION

PATENT NO. : 6,753,304 B1
DATED : June 22, 2004
INVENTOR(S) : Barthelemy et al.

It is certified that error appears in the above-identified patent and that said Letters Patent is hereby corrected as shown below:

Title page,
Item [*] Notice, delete "163" and insert -- 382 --.

Signed and Sealed this

Thirtieth Day of August, 2005

JON W. DUDAS
*Director of the United States Patent and Trademark Office*